US007211234B2

(12) United States Patent
Kolis et al.

(10) Patent No.: US 7,211,234 B2
(45) Date of Patent: May 1, 2007

(54) HYDROTHERMAL GROWTH OF LANTHANIDE VANADATE CRYSTALS FOR USE IN LASER AND BIREFRINGENT APPLICATIONS AND DEVICES

(75) Inventors: Joseph W Kolis, Central, SC (US); Steven J Syracuse, Charlotte, NC (US)

(73) Assignee: Clemson University, Clemson, SC (US)

( * ) Notice: Subject to any disclaimer, the term of this patent is extended or adjusted under 35 U.S.C. 154(b) by 239 days.

(21) Appl. No.: 11/029,291

(22) Filed: Jan. 5, 2005

(65) Prior Publication Data

US 2006/0147363 A1 Jul. 6, 2006

(51) Int. Cl.

| | |
|---|---|
| ***C01F 1/00*** | (2006.01) |
| ***C01F 17/00*** | (2006.01) |
| ***C01G 1/00*** | (2006.01) |
| ***C01G 31/00*** | (2006.01) |

(52) U.S. Cl. ..... 423/263; 423/594.8; 423/595; 423/598

(58) Field of Classification Search ..... 423/594.8, 423/263, 598, 595

See application file for complete search history.

(56) References Cited

U.S. PATENT DOCUMENTS

| | | | | |
|---|---|---|---|---|
| 3,485,768 | A * | 12/1969 | Ropp | 252/301.4 R |
| 3,501,412 | A * | 3/1970 | Ropp | 252/301.4 R |
| 3,505,241 | A * | 4/1970 | Mathers | 252/301.4 R |

FOREIGN PATENT DOCUMENTS

| | | | |
|---|---|---|---|
| JP | 5-238897 | A * | 9/1993 |
| JP | 9-83058 | A * | 3/1997 |
| JP | 2003-149442 | A * | 5/2003 |

OTHER PUBLICATIONS

Byrappa & Ohachi eds., Crystal Growth Technology, Williams Andrew Pubs., (2002), Chapter 10 pp. 335-363, no month.

Byrappa & Nirmala, Ind. J. Phys 73A(5), (1999), pp. 621-632, no month.

* cited by examiner

*Primary Examiner*—Timothy C. Vanoy
(74) *Attorney, Agent, or Firm*—Leigh P Gregory, Attorney at Law

(57) ABSTRACT

The present invention is directed to lanthanide vanadate crystals having the formula $LnVO_4$, wherein Ln is selected from La, Nd, Ce, Pr, Pm, Sm, Eu, Gd, Tb, Dy, Ho, Er, Tm, Yb, Lu, Y, and combinations of at least two thereof, made by a hydrothermal method for a wide variety of end-use applications. The present method requires reacting a source of $Ln^{3+}$ ions and a source of $VO_4^{3+}$ ions, wherein Ln is selected from the group consisting of La, Nd, Ce, Pr, Pm, Sm, Eu, Gd, Tb, Dy, Ho, Er, Tm, Yb, Lu, Y and combinations of at least two thereof, in an aqueous solution at a temperature of from about 350° C. to about 600° C. and at a pressure of from about 8 kpsi to about 40 kpsi, the aqueous solution comprising hydroxide ions at a concentration of from about 0.01 to about 5 molarity. Specifically, when made by the present hydrothermal method, single crystals of sufficient size for use in a variety of optical applications are readily formed.

17 Claims, 2 Drawing Sheets

HYDROTHERMAL GROWTH OF LANTHANIDE VANADATE CRYSTALS FOR USE IN LASER AND BIREFRINGENT APPLICATIONS AND DEVICES

FIELD OF THE INVENTION

The present invention is directed to lanthanide vanadate crystals having the formula $LnVO_4$, wherein Ln is selected from La, Nd, Ce, Pr, Pm, Sm, Eu, Gd, Tb, Dy, Ho, Er, Tm, Yb, Lu, Y, and combinations of at least two thereof, made by a hydrothermal method for a wide variety of end-use applications. Specifically, when made by the present hydrothermal method, single crystals of a size sufficient for use in a variety of optical applications are readily formed.

BACKGROUND OF THE INVENTION

It is well known that there is a steadily increasing demand for higher performance materials in optical applications. In many cases, these materials must be high quality single crystals of a size sufficiently large so that they are capable of being cut, shaped and polished into pieces several millimeters on a side. This is particularly true for solid state optical devices such as all solid state lasers and optical switching devices. For example, there has recently been a rapidly expanding application of new crystals finding use in diode pumped sold state lasers.

These all-solid state lasers typically use a diode laser to pump a solid crystal containing an activator ion to achieve population inversion. This excited ion emits an appropriate coherent wavelength or laser, creating a diode pumped solid state laser (DPSSL). Fully solid state lasers are desirable because they generally are compact, reliable, rugged, and have low power and cooling demands.

Most commonly, a solid state laser crystal will consist of a typical oxide host such as yttrium aluminum garnet (YAG) containing an activator ion such as $Nd^{3+}$ included in relatively low quantities (≦1%) within the crystal lattice. In traditional Nd: based lasers such Nd:YAG lasers, the $Nd^{3+}$ ion is pumped by a flash lamp into an absorption band near 808 nm. This populated state relaxes through a non-radiative pathway to a lower energy level that subsequently emits coherent radiation (lasing). In the specific case of $Nd^{3+}$ activated material, it generally emits a laser wavelength around 1064 nm. Flash lamps have inherent limitations because they have lifetimes of only several hundred hours, require large amounts of energy, emit enormous amounts of waste heat and require large amounts of cooling water. Thus many newer laser systems replace the flash lamp with a diode laser as the pumping source. A diode pumped source is desirable because it creates a much simpler, smaller and more reliable laser platform. DPSSLs require much less energy and produce much less waste heat than the traditional flash lamp pumped lasers. In addition, diode pumps provide wall plug sources over many thousand hours and require only air-cooling.

The most common source of gain medium of DPSSLs is Nd doped YAG produced by the Czochralski pulling technique. There are several problems with the traditional Nd:YAG as gain medium in DPSSLs. The primary limitation for Nd:YAG host is that the ligand field environment in YAG is such that the absorption band for the 808 pumping band is relatively narrow. Unfortunately, the emission wavelength for diode lasers tends to shift with changes in time and temperature. With a narrow absorption manifold around 808 nm, the excitation wavelength of the pumping diode can gradually shift away from the ideal pumping frequency of 808 μm. As this frequency moves away from the narrow absorption band, less energy from the pumping diode is absorbed by the $Nd^{3+}$ ion. This can lead to a loss in pumping efficiency over time that can severely reduce the performance of the laser. This problem has limited the full-scale implementation of DPSSLs.

To address the above shortcomings other single crystal hosts have been developed for DPSSLs. These include other gain media, especially $Nd:YVO_4$. The most promising host that has emerged for DPSSLs is yttrium orthovanadate $YVO_4$ (commonly called simply "vanadate"). This material forms in the tetrahedral space group $I4_1/amd$, and has a crystal structure that is completely different from the garnet structure of YAG. This alternative coordination environment for the $Nd^{3+}$ activator ion creates a much broader absorption manifold around the 808 nm pumping region. Thus, any gradual change in emission wavelength of the diode pump source does not result in any significantly decreased absorption or decreased pumping efficiency. Therefore, the $Nd:YVO_4$ crystal type has the highest gain coefficient and lowest threshold of the common DPSSL laser crystals. It has a three times larger cross section, shorter lifetime and a larger absorption coefficient than Nd:YAG, making $Nd:YVO_4$ the laser gain medium crystals of choice for DPSSL devices. Nd:YVO4 based DPSSL's have demonstrated high power performance with repetitions of nearly 160 GHz.

Recently other vanadates in single crystal form have emerged as useful DPSSL materials. In particular, $Nd:GdVO_4$ crystals and $Nd:Gd_xY_{(1-x)}VO_4$ can be grown in the same structure as the corresponding $Nd:YVO_4$ crystals. They show several characteristics that are superior to $Nd:YVO_4$ in crystal DPSSL lasers. In particular, the gadolinium containing crystals with formulas like $Nd:GdVO_4$ have significantly higher thermal conductivity than $Nd:YVO_4$ crystals. Thus, any waste heat can be more easily removed by an appropriate heat sink, reducing any deformation or distortion due to excess heat buildup such that crystals with these formulations can be used for lasers with higher power outputs. $Nd:GdVO_4$ crystals have displayed conversion efficiencies as high as 55% with 14 W output and 62% slope efficiencies. These are considerably higher than any corresponding $Nd:YVO_4$ crystals.

Pure undoped $YVO_4$ has several other attractive characteristics as well. In particular, it is a highly birefringent material with a value of $\Delta n=0.204$. Thus, it can be used as an alternative to calcite in polarizers and related applications.

Unfortunately, the crystal growth of either doped or undoped $YVO_4$ crystal is problematic. The material melts incongruently at 1860° C. Thus, it decomposes before it melts, so single crystals of the pure material cannot be grown by traditional Czochralski techniques like Nd:YAG. In addition, the material suffers several other inherent limitations at high temperature. Above about 1000° C. the lattice host material $YVO_4$ begins to extrude vanadium oxide ($V_2O_5$). This leads to lattice defects and chemical non-stoichiometry, both of which severely reduce the performance of the laser crystal. Most importantly, at high temperatures, the pentavalent vanadium ($V^{5+}$) of the host material becomes reduced to $V^{4+}$ or $V^{3+}$. These reduced metal sites absorb light strongly and severely degrade the performance of the laser crystal. It should be noted that all of these harmful effects are inherent in the high temperature crystal growth process. The only way to completely eliminate these deficiencies is to lower the temperature at which the crystals are grown.

There have been several attempts to grow these vanadates by other methods, such as, primarily, flux growth, floating zone and top seeded solution growth. These techniques lead to single crystals of $YVO_4$ and Nd:$YVO_4$. However, in all these cases the growth temperature still exceeds 1100° C. and numerous defects due to non-stoichiometry and reduced vanadium ions are still present. Specifically, all heretofore available synthetic methodologies have had considerable shortcomings, leading to defects, inhomogeneities, and "c-axis wander" all of which lead to decreased performance.

Hydrothermal techniques are an excellent route to high quality single crystals for electro-optic applications. For example, all electronic grade quartz is grown commercially by the hydrothermal method. Further, KTP is grown by both flux and hydrothermal methods, and it is widely acknowledged by those skilled in the art that the hydrothermally grown product is of generally superior quality. The hydrothermal method involves the use of superheated water (liquid water heated above its boiling point) under pressure to cause transport of soluble species from a nutrient rich zone to a supersaturated growth zone. Generally a seed crystal is placed in the growth zone. The growth and supersaturation control is achieved by the use of differential temperature gradients. The superheated fluid is generally contained under pressure, typically 5–30 kpsi, in a metal autoclave. Depending on the chemical demands of the system the autoclave can be lined with a nobel metal using a either fixed or floating liner. These general techniques are well known in the art and have been used for the growth of a variety of other electro-optic crystals.

There have been several earlier publications that describe one method of hydrothermal crystal growth of Ln:$MVO_4$, (Ln=Nd, Eu, M=Y, Gd). However, all of these earlier procedures describe hydrothermal growth in strongly acidic solution with pH values below pH=0.15. These earlier reports clearly state that solutions with high pH or alkaline solutions are not usable as they lead to formation of $Y(OH)_3$ instead of the desired material. In addition, the previous reports involve temperatures below 300° C. These reports state that solubility in these strongly acidic solutions decreases steadily from 180° C. to 300° C. (negative solubility) and state explicitly ". . . that above 300° C. the solubility does not change much, which suggests that crystal growth beyond this temperature is not practical". Most importantly, these previous reports specifically describe only the spontaneous nucleation of very tiny crystals completely unusable for any current device application as described above. There is no mention of transport growth to seeds for the production of large crystals that are useful for device applications. (See, K. Byrappa, T. Ohachi (Eds.) Crystal Growth Technology, William Andrew Pubs, 2002 Chapter 10 pp 335–363; K. Byrappa, B. Nirmala, Ind. J. Phys 73A(5) (1999) pp 621–632)

SUMMARY OF THE INVENTION

Accordingly, the present invention is directed to a new hydrothermal method to grow high quality single crystals of $LnVO_4$ and Ln'$LnVO_4$ in all their various combinations where Ln=La, Nd, Ce, Pr, Pm, Sm, Eu, Gd, Tb, Dy, Ho, Er, Tm, Yb, Lu, and Y and Ln'=La, Nd, Ce, Pr, Pm, Sm, Eu, Gd, Tb, Dy, Ho, Er, Tm, Yb, Lu, and Y and other metal ions possessing a trivalent charge including $Cr^{3+}$ and $Ti^{3+}$. The method is a low temperature method compared to existing melt growth methods, with crystals being grown at temperatures generally below 600° C. The technique disclosed herein allows for production of crystals grown to sufficiently large size to be useful in optical and optoelectronic applications. This size can be in excess of one millimeter on any edge and typically is in excess of 3–5 mm on any edge.

This is achieved by providing a method for making tetragonal lanthanide vanadate crystals having the formula $LnVO_4$ wherein Ln is selected from the group consisting of La, Nd, Ce, Pr, Pm, Sm, Eu, Gd, Tb, Dy, Ho, Er, Tm, Yb, Lu, Y and combinations of at least two thereof which includes the step of reacting a source of $Ln^{3+}$ ions and a source of $VO_4^{3-}$ ions, wherein Ln is selected from the group consisting of La, Nd, Ce, Pr, Pm, Sm, Eu, Gd, Tb, Dy, Ho, Er, Tm, Yb, Lu, Y and combinations of at least two thereof, in an aqueous solution at a temperature of from about 350° C. to about 600° C. and at a pressure of from about 8 kpsi to about 30 kpsi, the aqueous solution including hydroxide ions at a concentration of from about 0.01 to about 5 molarity. The present invention is also directed to a tetragonal lanthanide vanadate crystal made by this method.

Further, the present invention is directed to a tetragonal lanthanide vanadate crystal having the formula $Ln_xLn_yVO_4$ wherein $Ln_x$ is selected from the group consisting of La, Nd, Ce, Pr, Pm, Sm, Eu, Gd, Tb, Dy, Ho, Er, Tm, Yb, Lu, and Y and wherein $Ln_y$ is selected from the group consisting of La, Nd, Ce, Pr, Pm, Sm, Eu, Gd, Tb, Dy, Ho, Er, Tm, Yb, Lu, Y, Ti, and Cr, wherein $Ln_x$ and $Ln_y$ are differing ions, made by the method which includes the step of reacting a source of $(Ln_x)^{3+}$ ions, a source of $(Ln_y)^{3+}$ ions, and a source of $VO_4^{3-}$ ions, wherein $Ln_x$ is selected from the group consisting of La, Nd, Ce, Pr, Pm, Sm, Eu, Gd, Tb, Dy, Ho, Er, Tm, Yb, Lu, and Y and wherein $Ln_y$ is selected from the group consisting of La, Nd, Ce, Pr, Pm, Sm, Eu, Gd, Tb, Dy, Ho, Er, Tm, Yb, Lu, Y, Ti, and Cr, wherein $Ln_x$ and $Ln_y$ are differing ions, and wherein the molar ratio of $(Ln_x)^{3+}$ and $(Ln_y)^{3+}$ to $VO_4^{3-}$ is 1:1 and wherein the molar ratio of $(Ln_x)^{3+}$ to $(Ln_y)^{3+}$ is from about 99:1 to about 80:20, in an aqueous solution at a temperature of from about 350° C. to about 600° C. and at a pressure of from about 8 kpsi to about 30 kpsi, the aqueous solution including hydroxide ions at a concentration of from about 0.01 to about 5 molarity.

Additionally, the present invention is directed to a tetragonal lanthanide vanadate crystal having the formula $LnVO_4$ wherein Ln is selected from the group consisting of La, Nd, Ce, Pr, Pm, Sm, Eu, Gd, Tb, Dy, Ho, Er, Tm, Yb, Lu, Y and combinations of at least two thereof, grown by a method which includes the steps of: providing a pressure vessel having a growth region and a nutrient region, providing a seed crystal having having the formula $LnVO_4$ wherein Ln is selected from the group consisting of La, Nd, Ce, Pr, Pm, Sm, Eu, Gd, Tb, Dy, Ho, Er, Tm, Yb, Lu, Y and combinations of at least two thereof, positioning the seed crystal in the growth region of the pressure vessel, providing a medium comprising a nutrient and a mineralizer in the nutrient region, the nutrient comprising powdered or microcrystalline $LnVO_4$ wherein Ln is selected from the group consisting of La, Nd, Ce, Pr, Pm, Sm, Eu, Gd, Tb, Dy, Ho, Er, Tm, Yb, Lu, Y and combinations of at least two thereof, the mineralizer comprising hydroxide ions, and heating and pressurizing the vessel such that a growth temperature is produced in the growth region, a nutrient temperature is produced in the nutrient region, and a temperature gradient is produced between the growth region and the nutrient region, whereby growth of the crystal is initiated, the growth temperature ranging from about 350° C. to about 550° C., the nutrient temperature ranging from about 400° C. to about 600° C., and the pressure ranging from about 8000 psi to about 30,000 psi.

BRIEF DESCRIPTION OF THE FIGURES OF THE DRAWING

The accompanying drawings, which are incorporated in and constitute a part of the specification, illustrate presently preferred embodiments of the present invention and, together with the general description given above and the detailed description of the preferred embodiments given below, serve to explain the principles of the present invention.

DETAILED DESCRIPTION OF THE PREFERRED EMBODIMENTS

Figure 1:
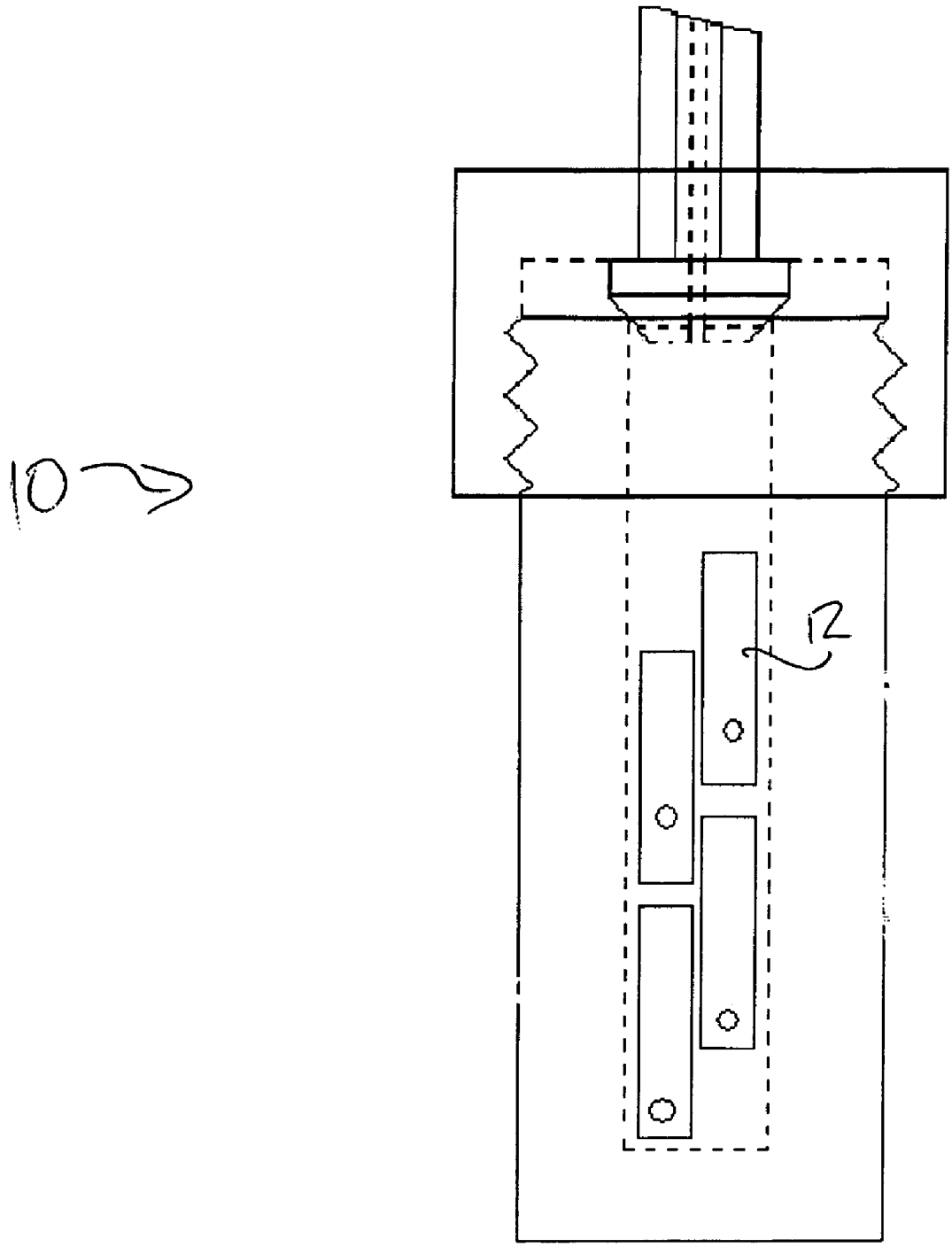
FIG. 1 schematically illustrates an autoclave loaded for crystal growth under hydrothermal conditions.

Contrary to the above described prior art, the present application is directed to a process to grow single crystals of $LnVO_4$ (where Ln can be La, Nd, Ce, Pr, Pm, Sm, Eu, Gd, Tb, Dy, Ho, Er, Tm, Yb, Lu, Y or any combination of two or more) which are of sufficient size to be cut into crystals for use in solid state lasers and optical switches (generally, equal or greater than 2 mm per side). This method involves growth in strongly alkali solutions with high concentrations of $OH^-$, at temperatures between 350° C. and 600° C. and pressures between 6000 and 30,000 psi. The process is unique in that it provides a useful, technologically applicable method to grow crystals of sufficient size for use in laser and optoelectronic devices. This disclosure demonstrates conclusively that large single crystals can be grown in hydrothermal solutions above 300° C. with relatively high hydroxide ($OH^-$) concentrations and that the materials have a positive solubility coefficient allowing transport from a hotter feedstock zone to a relatively cooler growth zone.

This method can also be extended to crystals that contain mixtures of lanthanide ions in many combinations and relative amounts. The ions of the mixture can be selected from any combination of of La, Nd, Ce, Pr, Pm, Sm, Eu, Gd, Tb, Dy, Ho, Er, Tm, Yb, Lu, Y, Ti and Cr and mixtures thereof. All lanthanide ions can be substituted for each other in percentages up to 50% using the method disclosed herein. Thus $Nd^{3+}$ ions can be substituted for $Y^{3+}$ to form $Nd_xY_yVO_4$ where x can range from 1–50%. Similarly this method can be used to prepare $Yb_xGd_yVO_4$ where in this case x can range from 1 to 50%. This also includes combinations where two or more lanthanide ions of different identities can be present at the same time as long as their total percentages equal 100%. Thus elements can be combined like $Ho_xEr_{x'}Y_yVO_4$, where x can equal 20%, x' can equal 1% and y can equal 79%.

In addition to applications as solid state laser ion sources, the parent material $YVO_4$ has a very high birefringence and can find utility in numerous optoelectronic applications. Specifically, the polar nature of the structure allows use in applications including but not limited to birefringence, filtering, wave guides, double refraction, polarization, wave plates, prisms and retarders. The birefringent values of the present inventive crystals are greater than 0.20, which is greater than $LiNbO_3$ (0.7) and Calcite (0.15), the two most common birefringent materials currently used in optoelectronic devices and applications. Thus, $YVO_4$ and other $LnVO_4$ crystals in accordance with the present invention are desirable materials to replace or augment these prior materials as the increased birefringence can allow for smaller, lighter devices.

Additionally, since the present hydrothermal crystal growth technique allows growth at much lower temperatures than current methods (ca. 500° C. as compared to 1800° C.) birefringent crystals with much lower defects and inhomogeneities are formed.

Further, the present crystals can be doped (or co-doped) to contain laser active ions (one or more of any of the lanthanide ions or other trivalent metal ions such as $Ti^{3+}$ or $Cr^{3+}$). Thus the materials can be used as hosts for new laser crystals.

Specifically, tetragonal lanthanide vanadate crystals which have the formula $Ln_xLn_yVO_4$ wherein $Ln_x$ is selected from the group consisting of La, Nd, Ce, Pr, Pm, Sm, Eu, Gd, Tb, Dy, Ho, Er, Tm, Yb, Lu, and Y and wherein $Ln_y$ is selected from the group consisting of La, Nd, Ce, Pr, Pm, Sm, Eu, Gd, Tb, Dy, Ho, Er, Tm, Yb, Lu, Y, Ti, and Cr, wherein $Ln_x$ and $Ln_y$ are differing ions, made in accordance with the present invention exhibit very wide bandgaps, high optical damage thresholds, and good thermal stability, as well as broad absorption bands and excellent emission properties. Many trivalent lanthanide ions display active emission of coherent radiation when doped into appropriate hosts. Upon pumping with an appropriate pump source (i.e. diode, solid state, gas, or excimer lasers, or arc, mercury or other lamp), the lanthanide ions display exhibit emission of coherent radiation (laser emission). The coherent radiation emission properties of the various trivalent lanthanide lasing ions are well described in the literature. The lanthanide vanadates display many of the desirable characteristics of laser hosts, particularly $YVO_4$ and $GdVO_4$ and their various combinations. They have broad absorption bands, making them particularly suitable for diode pumping sources. In addition the gadolinium material has higher thermal conductivity than the yttrium analog making it desirable as a high powered laser since heat can be removed more easily. Both $YVO_4$ and $GdVO_4$ can be doped with one or more of any of the known lanthanide trivalent ions or chromium 3+ in a wide variety of combinations. Given this ability, a wide variety of new laser crystals can be created with the general formula $Ln_xLn_yVO_4$ (where x+y=1) and most of these should display useful laser activity. Their suitability for diode pumping and versatility of doping makes them a very promising material for high powered all solid state lasers. The technology disclosed herein describes the growth of high quality single crystals of sufficient size for use in numerous types of laser devices.

Thus, in accordance with the present invention, water containing alkali metal hydroxide (typically but not exclusively LiOH, NaOH or KOH) sufficient to create an $OH^-$ concentration between $1\times10^{-3}$M to 5M heated to temperatures between 350° C. and 600° C. at pressures between 6 and 30 kpsi leads to formation of $LnVO_4$ when $Ln_2O_3$ and $V_2O_5$ are used as starting materials. Alternatively, the $V_2\mathbf{0}_5$ can be replaced by another vanadium source such as $NaVO_3$ or $Na_3VO_4$. Typically the vanadium source is present in excess to inhibit formation of $Ln(OH)_3$. An alternative source for the lanthanide ion is $Ln(NO_3)_3$.

FIG. 1 schematically represents a preferred autoclave 10 employed in achieving the temperature and pressure conditions necessary for the present reaction. The reactants are added to a silver tube 12 having a diameter of 0.25 in and a length of 2 in. Then, the hydroxide source is added to the tube and it is welded shut. The sealed tube or ampoule is placed in the autoclave which has an internal diameter of ½ in and a depth of 6 in. Water is added to the autoclave, filling approximately 75% of the remaining free volume of the autoclave. The autoclave is sealed shut using a cold seal. The sealed autoclave containing the sealed silver ampoule is placed in a tube furnace oriented in a vertical position. The furnace is heated to the desired elevated temperature and held at that temperature for an extended period of time. The water in the autoclave expands at this elevated temperature to create the desired elevated pressure. Thereafter, the autoclave is removed from the oven and cooled in a stream of air.

In an alternative growth scenario, reaction conditions similar to those described above are used to dissolve, transport and grow large crystals of $LnVO_4$ starting from a suitable feedstock of nominal formula $LnVO_4$ made via methods described above or any other suitable method. The seed crystal of $LnVO_4$ is suspended in the upper or "cool" zone of the container and a suitable feedstock of powered or microcrystalline $LnVO_4$ is placed in the lower or "hot" zone. A thermal gradient of 10–100° C. is established by the use of multiple independent heating coils. This thermal gradient leads to transport and growth of LnVO4 from the feedstock to the seed crystal. The thermal gradient induces transport because 1) it causes supersaturation at the seed in the "cool" zone leading to precipitation and 2) the thermal gradients induce the formation of convection currents leading to mass transfer from the feedstock to growth zone. Thus, the small seed crystals ripen and increase in size eventually become sufficiently large to be useful in optical applications.

Figure 2:
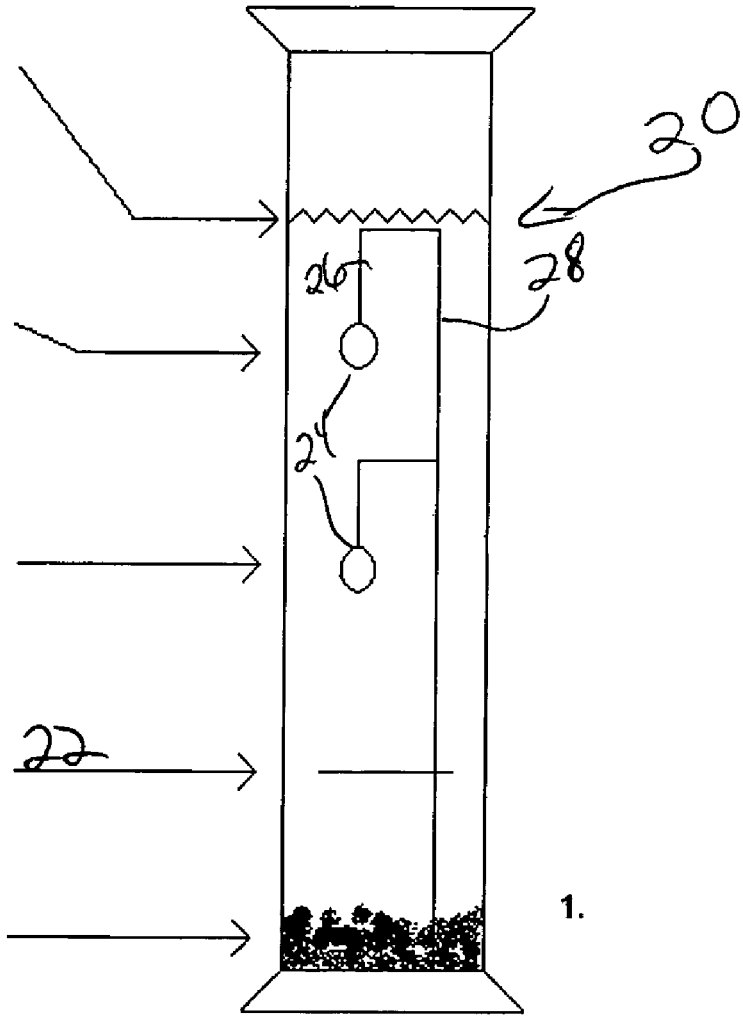
FIG. 2 schematically illustrates a silver tube with seed crystals suspended from a ladder for the growth of larger crystals in accordance with one method of the present invention, specifically a transport growth technique.

Specifically, the apparatus for performing the hydrothermal growth transport method is shown in FIG. 2 which shows silver tube 20, preferably of dimensions ⅜ in by 6 in. A silver baffle 22 with three small holes in it is placed 1.25 in above the bottom of the tube. Two single crystals 24 of $LnVO_4$ prepared in accordance with the present invention, each approximately 2×2×4 mm, serve as seeds. Holes are drilled in the crystals and they are hung by silver thread 26 on a small silver ladder 28 placed within the tube. The two seed crystals are hung 2.75 in and 3.75 in above the bottom of the tube, respectively. Preferably, the aqueous hydroxide is added to the tube and fills about 80% of the remaining volume of the tube. The tube is welded shut and placed in an autoclave with a cold seal and a ½ in by 8 in opening. An amount of water sufficient to occupy 80% of the remaining free volume is added and the autoclave sealed and placed in an upright tube furnace. The autoclave is heated with a temperature gradient. After an extended period of time, the autoclave is cooled, opened and the silver tube opened.

Growths are typically performed in autoclaves capable of containing the high temperatures and pressures, usually constructed of a nickel-based alloy such as Inconel or Rene 41. The containers typically contain noble metal liners of either the floating or fixed variety.

Further illustrations of the invention are provided in the Examples, below.

EXAMPLE 1

In accordance with the present invention, 62 mg $Y_2O_3$ and 200 mg $V_2O_5$ were added to a silver tube of 0.25 in. in diameter and 2 in. in length. A 2M solution of NaOH 0.40 ml was added to the tube that was then welded shut. The sealed tube (ampoule) was placed in an autoclave with an internal diameter of ⅜ in or ½ in and a depth of 6 in. Water was added to the autoclave sufficient to create a pressure of 15,500 psi when the autoclave is heated to the ultimate reaction temperature. This amount is typically approximately 75% of the remaining free volume of the autoclave. The autoclave was sealed shut using a cold seal, although a Bridgeman seal is also sufficient. The sealed autoclave containing the sealed silver ampoule was placed in a tube furnace oriented in a vertical position. The furnace was heated to 550° C. and held at that temperature for three days. The water in the autoclave expanded at this temperature to create a pressure of 15,500 psi. After three days of continuous heating, the autoclave was removed from the oven and cooled in a stream of air. After the autoclave cooled to room temperature it was opened, the silver tube cut open with pliers and the crystals of $YVO_4$ isolated as colorless prisms of approximate dimension 1×2×2 mm. The identity of the crystals was confirmed by both powder and single crystal x-ray diffraction, which determined the unit cell of the material to be orthorhombic in space group $I4_1/amd$ with a=b=7.119 Å, c=6.290 Å. This unit cell is identical to the tetragonal Wakefieldite structure type reported for the naturally occurring material as well as that of the commercially available material of the prior art.

EXAMPLE 2

This Example describes in detail the creation of high quality single crystals of $YVO_4$ doped with an active lasing ion, namely neodymium, and having the formula $Nd_{0.02}Y_{0.98}VO_4$. Using a procedure identical to that described in Example 1, except the staring materials were 100 mg $Y_2O_3$, 3 mg $Nd_2O_3$ and 260 mg $V_2O_5$ solids, the same heating procedure was followed. Once again, pale blue-purple single crystals of high quality and size (2×2×1 mm) were isolated. The elemental ratios were confirmed as those above using an EDAX scanning electron microscope. Further, the characteristic emissions of the luminescence spectrum of $Nd_{0.02}Y_{0.98}VO_4$ were confirmed.

EXAMPLE 3

This Example describes in detail the growth of a large single crystal of $Nd_{0.02}Y_{0.98}VO_4$ suitable for cutting and polishing for use as a source crystal in a typical laser device. A ground microcrystalline feedstock of the formula $Nd_{0.02}Y_{0.98}VO_4$, as prepared in Example 2, was employed although such may have been obtained from a precipitation reaction as in Roppe (U.S. Pat. No. 3,580,861) or Riwotzki et al (J. Phys. Chem. 1998, 102, 10129–10135). The feedstock material of quantity 1 gram was placed in a silver tube of ⅜ in diameter and 6 inches long with a welded bottom. A small baffle was suspended just above the top of the feedstock and a small seed crystal (approx 1 mm on a side) of $YVO_4$ was hung by a silver wire near the top of the tube. A water solution of 2M NaOH was added to the tube to fill 75% of the remaining volume and the tube, which was then crimped and welded shut. The tube was placed in an autoclave as described above and the autoclave was heated such that the bottom of the autoclave was at a temperature of 550° C. and the top of the autoclave was held at a temperature of 475° C. The autoclave was heated in this manner for 12 days. The pressure in this case was 12,350 psi. at the reaction temperature. After this time, the autoclave was cooled, opened and the product removed. The seed crystal had added considerable mass and had growth of substantial quantity of $Nd_{0.02}Y_{0.98}VO_4$ as a single crystal on the seed. In this manner, single crystals larger than 1 cm per edge were prepared. The crystals were the characteristic blue-lavender color and characterized by powder X-ray diffraction which was identical to the structure of the $Nd_{0.02}Y_{0.98}VO_4$ starting material. The elemental composition described above was verified by EDX scanning electron microscopy.

Preferred embodiments of the invention have been described using specific terms and devices. The words and terms used are for illustrative purposes only. The words and terms are words and terms of description, rather than of limitation. It is to be understood that changes and variations may be made by those of ordinary skill art without departing from the spirit or scope of the invention, which is set forth in the following claims. In addition it should be understood that aspects of the various embodiments may be interchanged in whole or in part. Therefore, the spirit and scope of the appended claims should not be limited to descriptions and examples herein. Moreover, Applicants hereby disclose all sub-ranges of all ranges disclosed herein. These sub-ranges are also useful in carrying out the present invention.

We claim:

1. A method for making tetragonal lanthanide vanadate crystals having the formula $LnVO_4$ wherein Ln is selected from the group consisting of La, Nd, Ce, Pr, Pm, Sm, Eu, Gd, Tb, Dy, Ho, Er, Tm, Yb, Lu, Y and combinations of at least two thereof, comprising the steps of:

reacting a source of $Ln^{3+}$ ions and a source of $VO_4^{3-}$ ions, wherein Ln is selected from the group consisting of La, Nd, Ce, Pr, Pm, Sm, Eu, Gd, Tb, Dy, Ho, Er, Tm, Yb, Lu, Y and combinations of at least two thereof, in an aqueous solution at a temperature of from about 350° C. to about 600° C. and at a pressure of from about 8 kpsi to about 40 kpsi, the aqueous solution comprising hydroxide ions at a concentration of from about 0.01 to about 5 molarity.

2. The method set forth in claim 1 wherein the source of $Ln^{3+}$ ions is selected from $Ln_2O_3$ and $Ln(NO_3)_3$.

3. The method set forth in claim 1 wherein the source of $VO_4^-$ ions is selected from $V_2O_3$, $NaVO_3$, and $Na_3$ $VO_4$.

4. The method set forth in claim 1 wherein the step of reacting a source of $Ln^{3+}$ ions and a source of $VO_4^{3-}$ ions occurs in an aqueous solution comprising hydroxide ions at a concentration of from about 0.1 to about 5 molanty.

5. The method set forth in claim 1 wherein the step of reacting a source of $Ln^{3+}$ ions and a source of $VO_4^{3-}$ ions occurs in an aqueous solution at a temperature of from about 400° C. to about 600° C.

6. The method set forth in claim 1 wherein the step of reacting a. source of $Ln^{3+}$ ions and a source of $VO_4^{3-}$ ions occurs in an aqueous solution at a pressure from about 8 kpsi to about 30 kpsi.

7. A method for making a tetragonal lanthanide vanadate crystal having the formula $Ln_xLn_yVO_4$ wherein $Ln_x$ is selected from the group consisting of La, Nd, Ce, Pr, Pm, Sm, Eu, Gd, Tb, Dy, Ho, Er, Tm, Yb, Lu, and Y and wherein $Ln_y$ is selected from the group consisting of La, Nd, Ce, Pr, Pm, Sm, Eu, Gd, Tb, Dy, Ho, Er, Tm, Yb, Lu, Y, Ti, and Cr, wherein $Ln_x$ and $Ln_y$ are differing ions, comprising the steps of:

reacting a source of $(Ln_x)^{3+}$ ions, a source of $(Ln_y)^{3+}$ ions, and a source of $VO_4^{3-}$ ions, wherein $Ln_x$ is selected from the group consisting of La, Nd, Ce, Pr, Pm, Sm, Eu, Gd, Tb, Dy, Ho, Er, Tm, Yb, Lu, and Y and wherein $Ln_y$ is selected from the group consisting of La, Nd, Ce, Pr, Pm, Sm, Eu, Gd, Tb, Dy, Ho, Er, Tm, Yb, Lu, Y, Ti, and Cr, wherein $Ln_x$ and $Ln_y$ are differing ions, and wherein the molar ratio of $(Ln_x)^{3+}$ ions and $(Ln_y)^{3+}$ ions to $VO_4^{3-}$ ions is 1:1 and wherein the molar ratio of $(Ln_x)^{3+}$ to $(Ln_y)^{3+}$ is from about 99:1 to about 80:20, in an aqueous solution at a temperature of from about 350° C. to about 600° C. and at a pressure of from about 8 kpsi to about 40 kpsi, the aqueous solution comprising hydroxide ions at a concentration of from about 0.01 to about 5 molarity.

8. The method set forth in claim 7 wherein the step of reacting a source of $(Ln_X)^{3+}$ ions, a source of $(Ln_y)^{3+}$ ions, and a source of $VO_4^{3-}$ ions occurs in an aqueous solution comprising hydroxide ions at a concentration of from about 0.1 to about 5 molarity.

9. The method set forth in claim 7 wherein the step of reacting a source of$(Ln_x)^{3+}$ ions, a source of $(Ln_y)^{3+}$ ions, and a source of $VO_4^{3-}$ ions occurs in an aqueous solution at a temperature of from about 400° C. to about 600° C.

10. The method set forth in claim 7 wherein the step of reacting a source of $(Ln_x)^{3+}$ ions, a source of $(Ln_y)^{3+}$ ions, and a source of $VO_4^{3-}$ ions occurs in an aqueous solution at a pressure from about 8000 psi to about 30,000 psi.

11. The method set forth in claim 7 wherein the crystal exhibits birefringent optical properties.

12. The method set forth in claim 7 wherein the crystal exhibits coherent laser emission properties.

13. A method for growing a tetragonal lanthanide vanadate crystal having the formula $LnVO_4$ wherein Ln is selected from the group consisting of La, Nd, Ce, Pr, Pm, Sm, Eu, Gd, Tb, Dy, Ho, Er, Tm, Yb, Lu, Y and combinations of at least two thereof, comprising the steps of:

providing a pressure vessel having a growth region and a nutrient region;

providing a seed crystal having the formula $LnVO_4$ wherein Ln is selected from the group consisting of La, Nd. Ce, Pr, Pm, Sm, Eu, (Id, Tb, Dy, Ho, Er, Tm, Yb, Lu, Y and combinations of at least two thereof;

positioning the seed crystal in the growth region of the pressure vessel;

providing a medium comprising a nutrient and a mineralizer in the nutrient region, the nutrient comprising powdered or microcrystalline $LnVO_4$ wherein Ln is selected from the group consisting of La, Nd, Ce, Pr, Pm, Sm, Eu, Gd, Tb, Dy, Ho, Er, Tm, Yb, Lu, Y and combinations of at least two thereof, the mineralizer comprising hydroxide ions; and heating and pressurizing the vessel such that a growth temperature is produced in the growth region, a nutrient temperature is produced in the nutrient region, and a temperature gradient is produced between the growth region and the nutrient region, whereby growth of the crystal is initiated, the growth temperature ranging from about 350° C. to about 550° C., the nutrient temperature ranging from about 400° C. to about 600° C., the nutrient temperature being higher than the growth temperature and the pressure ranging from about 8000 psi to about 40,000 psi.

14. A method as set forth in claim 13 wherein the hydroxide ions are present in the medium at a concentration of from about 0.1 to about 5 molarity.

15. A method as set forth in claim 13 wherein the growth temperature ranges from about 350° C. to about 600° C.

16. A method as set forth in claim 13 wherein the nutrient temperature ranges from about 350° C. to about 600° C.

17. A method as set forth in claim 13 wherein the pressure ranges from about 8000 kpsi to about 30,000 kpsi.

* * * * *